United States Patent [19]

Webster

[11] 4,441,580

[45] Apr. 10, 1984

[54] ACOUSTICAL CONTROL MEDIA

[75] Inventor: Michael P. Webster, Grand Rapids, Mich.

[73] Assignee: Steelcase Inc., Grand Rapids, Mich.

[21] Appl. No.: 197,817

[22] Filed: Oct. 17, 1980

[51] Int. Cl.[3] ..... E04B 1/82

[52] U.S. Cl. ..... 181/286; 181/290; 181/293

[58] Field of Search ..... 181/284, 286, 287, 290–293, 181/295; 55/276

[56] References Cited

U.S. PATENT DOCUMENTS

| | | | |
|---|---|---|---|
| 2,285,423 | 6/1942 | Esser | 181/290 |
| 2,694,025 | 11/1954 | Slayter et al. | 181/284 |
| 3,084,402 | 4/1963 | Jordan, Jr. et al. | 181/293 |
| 3,132,714 | 5/1964 | Gary, Jr. et al. | 181/286 |
| 3,166,149 | 1/1965 | Hulse et al. | 181/292 |
| 3,211,253 | 10/1965 | Gonzalez | 181/292 |
| 3,239,973 | 3/1966 | Hannes et al. | 52/144 |
| 3,384,199 | 5/1968 | Eckel | 181/290 |
| 3,441,465 | 4/1969 | Pearson | 181/290 X |
| 3,448,823 | 6/1969 | Smith | 181/290 |
| 3,502,171 | 3/1970 | Cowan | 55/276 X |
| 3,712,846 | 1/1973 | Daniels et al. | 181/290 X |
| 3,713,508 | 1/1973 | Eckel | 181/287 |
| 3,858,676 | 1/1975 | Le Masurier | 181/286 |
| 3,949,827 | 4/1976 | Witherspoon | 181/284 |
| 4,093,482 | 6/1978 | Ogata et al. | 181/284 X |
| 4,113,053 | 9/1978 | Matsumoto et al. | 181/284 |
| 4,152,474 | 5/1979 | Cook et al. | 181/291 X |
| 4,155,211 | 5/1979 | Saylor et al. | 181/295 X |
| 4,163,479 | 8/1979 | Bschorr | 181/286 |
| 4,203,639 | 5/1980 | Vanden Hoek et al. | 174/49 X |
| 4,213,516 | 7/1980 | Sulewsky | 181/286 |
| 4,248,325 | 2/1981 | Georgopoulos | 181/290 X |

*Primary Examiner*—Benjamin R. Fuller

*Attorney, Agent, or Firm*—Price, Heneveld, Huizenga & Cooper

[57] ABSTRACT

An acoustical control media includes an air impervious septum adjacent which there is positioned a relatively thick layer of low density filler material on the outside of which there is provided a relatively thin panel of medium density perforated material. The acoustical media so formed can be used in acoustical panels employed to separate work areas in an office and in such applications decorative coverings can be provided over the perforated layer. The structure so formed provides improved broad bandwidth absorption of acoustical energy.

17 Claims, 7 Drawing Figures

ACOUSTICAL CONTROL MEDIA

BACKGROUND OF THE DISCLOSURE

The present invention relates to acoustical control media which can be formed in panels or the like for use in noise reduction.

There exists a great variety of acoustical material used, in for example, sound absorbing panels forming room dividers in offices, ceiling tile, and the like. The existant structure typically relies on either the sound absorptive properties of a very low density typically fiberglass material useful in absorbing higher frequency components of undesired noise. Frequently, in connection with such fill materials, solid barriers also are employed for blocking high and low frequency energy. High density perforated surface material has been employed also and in some cases in combination with cellular chambers to provide resonant cavities at the audible spectrum for absorbing lower frequency components of acoustical energy. Representative of such prior art are U.S. Pat. Nos. 3,132,714; 3,166,149; 3,211,253; 3,384,199; 3,448,823; 3,502,171; 3,712,846; 3,949,827; 4,155,211. A discussion of the mathematical principles associated with perforated panels is provided in an article entitled "Sound Absorption by Structures with Perforated Panels" by Jacques Brillouin, published in *Sound and Vibration* in July 1968.

Although the prior art structures provide noise reduction at either the upper or lower end of the frequency spectrum and some efforts have been made to broaden the bandwidth of the sound absorptive or controlling properties of acoustical panels employing for example a combination of techniques, existant structure has not provided the degree of noise isolation desirable in modern offices in which room dividing acoustical panels are employed to divide an office space into individual work areas. In this environment, a relatively small decible change in noise reduction provides a significant increase in privacy for the work areas. Typically to improve low frequency attenuation the thickness of a given sound absorptive panel is increased. It is desirable however to provide as thin an acoustical panel as possible to conserve space as well as provide an aesthetically pleasing appearance.

SUMMARY OF THE PRESENT INVENTION

The acoustical control media of the present invention provides improved broad band reduction of noise by providing an air impervious septum and a perforated panel of medium density material spaced therefrom. In the preferred embodiment the medium density panel is perforated with spaced apertures having a perforation ratio in the neighborhood of about 0.04. In one embodiment of the invention the space between the septum and the medium density material is filled with a low density material. According to another aspect of the invention a panel of medium density material is provided and is bonded to a relatively thin acoustically transparent mat to improve tackability to the panel.

In applications such as acoustical panels employed in offices, a septum is provided and is spanned on opposite sides by the low density material and a perforated panel which can, if desired, be covered by a decorative fabric which is acoustically transparent.

These and other features, advantages and objects of the present invention will become apparent to those skilled in the art upon reading the following description thereof together with reference to the drawings in which:

DETAILED DESCRIPTION OF THE PREFERRED EMBODIMENT

Figure 1:
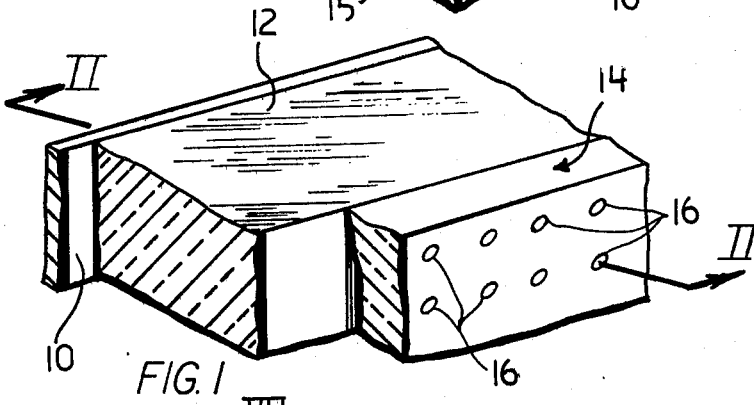
FIG. 1 is a fragmentary perspective view of one embodiment of the present invention.
Figure 2:
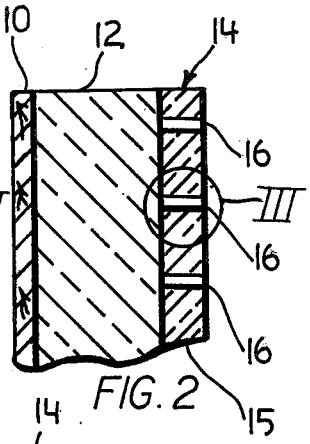
FIG. 2 is a cross-sectional view of the structure shown in FIG. 1 taken along the section lines II—II of FIG. 1.

Referring initially to FIG. 1 there is shown a section of the acoustical control media of the present invention which includes a septum 10 made of an air impervious material such as wood, steel, chipboard or fibreboard or other relatively high density air impervious material which in the preferred embodiment was about 0.060 inches thick although other thicknesses could be used. Positioned in abutting relationship to septum 10 is a relatively thick layer of low density sound absorptive material 12 comprising for example, in the preferred embodiment, fiberglass bat material having a thickness of $\frac{7}{8}$ of an inch and having a density in the range of about 0.5 to 3 pounds per cubic feet. On the outer surface which faces the source of sound energy to be absorbed or reduced, is a relatively thin layer 14 of a medium density sound absorptive material which in the preferred embodiment is perforated. Layer 14 may comprise a sound absorptive fiberous board 15 that ranges in density from 6–14 pounds per cubic foot. Bonded to the outer surface of material 15 is an acoustically transparent fiberglass mat 17 such as a speciality mat No. 7112 commercially available from Johns-Manville Products Corporation. The material 15 in the preferred embodiment had a thickness of approximately $\frac{1}{4}$ of an inch and was made of commercially available fiberglass board. Uniformally spaced and extending through layer 14 including material 15 and mat 17 is a plurality of apertures 16 which in the preferred embodiment comprises round holes formed through the layer at equal spacing intervals. The apertures 16 have a size and spacing such that the perforation ratio defined by the hole area divided by the total panel area is about 0.04. Examples of perforations to provide this perforation ratio is $\frac{1}{8}$ inch holes equally spaced at $\frac{1}{2}$ inch centers, 3/16 inch holes spaced at $\frac{3}{4}$ inch centers, and $\frac{1}{4}$ inch holes spaced at 1 inch centers, which provide perforation ratios of 0.045, 0.043, and 0.041 respectively. Mat 14 of the preferred embodiment has a density which provides tackability such that, if desired, objects can be secured to an acoustical panel formed of this construction. The outer mat 17, although increasing the structural rigidity and tackability of the layer 14 does not interfere with the transmission of acoustical energy to the medium density material.

The acoustical control media of the preferred embodiment of the invention substantially uniformly reduces noise in the range of 200 $H_z$ to about 5 $KH_z$ and tests in the range between 400 $H_z$ and 2 $KH_z$ indicate that the noise reduction at a 12 foot test position is in the neighborhood of at least 21 $NIC_F'$ measured according to the Public Building Service Test Method PBSC.2, (May 1975 revision) procedure III-S category B; primary flanking configuration. This construction has been found to also increase the attenuation of voice frequency energy in the range of about 500 to 1600 $H_z$ to improve office privacy when used in acoustical panels dividing an area into office spaces.

Figure 4:
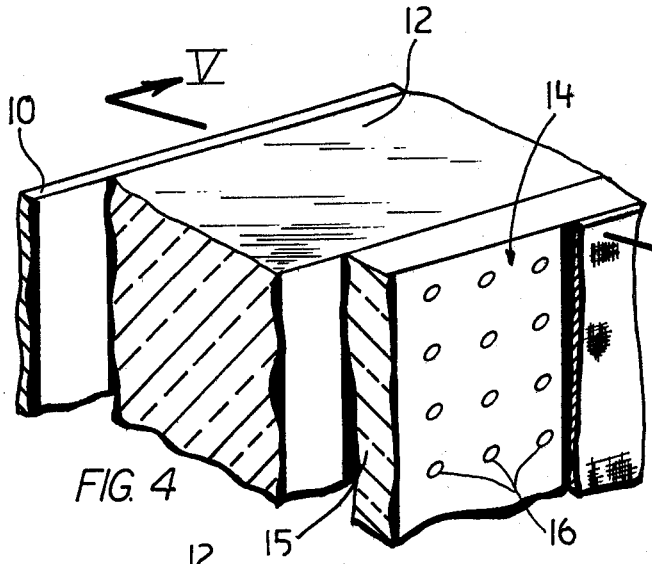
FIG. 4 is a fragmentary perspective view of an alternative embodiment of the present invention.
Figure 5:
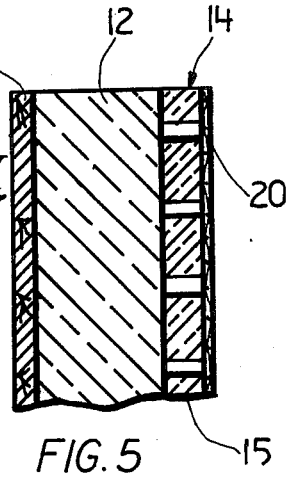
FIG. 5 is a cross-sectional view of the structure shown in FIG. 4 taken along the section lines V—V of FIG. 4.
Figure 6:
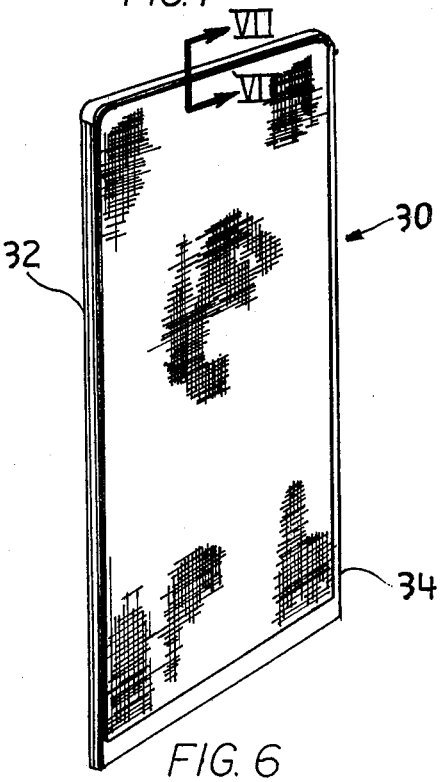
FIG. 6 is a perspective view of an acoustical panel embodying the present invention.
Figure 7:
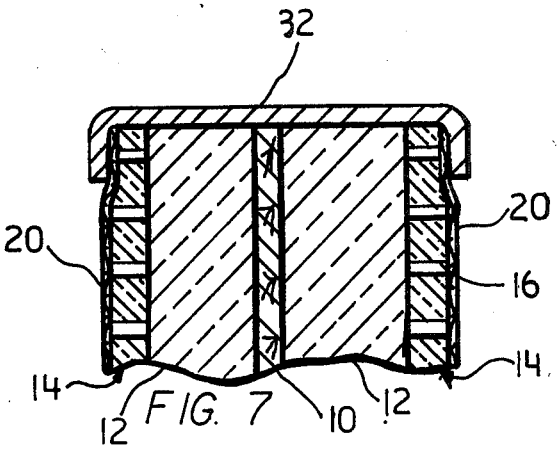
FIG. 7 is a fragmentary cross-sectional view of a portion of the structure shown in FIG. 6 taken along section lines VII—VII of FIG. 6.

FIGS. 4 and 5 show an alternative embodiment of the present invention in which a decorative fabric cover layer 20 is applied to the outer surface of the acoustical control media. The decorative cloth 20 is acoustically transparent and substantially air pervious (i.e. has at least 30% open space). As shown in FIGS. 6 and 7, the acoustical control media can be employed in an acoustical panel 30 of the type employed for the separation of office space into individual work areas. Panel 30 includes a frame 32 extending around the periphery thereof and in the preferred embodiment includes a base 34 through which electrical conductors provide electrical service for the offices defined by these separating panels. The construction of the panel frame can generally be of the type disclosed in U.S. Pat. No. 4,203,639 issued May 20, 1980 and assigned to the present assignee. The acoustical media of the present invention can as seen in FIG. 7 be provided on opposite sides of the septum 10 to provide sound isolation between opposite sides of such a panel. Naturally, the acoustical control media of the present invention can take forms other than panels shown in FIG. 6 and for example can be fabricated as wall hangings, walls, ceilings, or other shapes and sizes used for reducing acoustical energy transmission or reflection. The thickness of perforated material 14 can be varied so long as the density of the material falls within the desired range as does the perforation ratio. The middle layer 12 of low density material could in some instances be left as a void and the depth or density of the filler material or the depth of the void can be varied within reasonable ranges.

Figure 3:
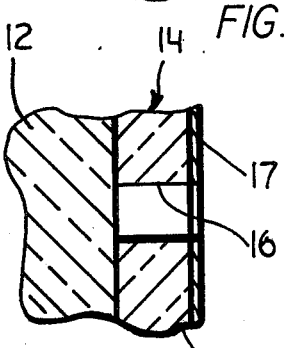
FIG. 3 is an enlarged view of the portion of FIG. 2 circled and identified by the reference III.

According to one aspect of the present invention an acoustical panel is provided of medium density material with or without perforations to which there is bonded a relatively thin fibrous mat. This construction is shown in FIG. 3 comprising a backing material 15 preferably of a fibrous nature and having a density of from about 6 to 14 pounds per cubic foot. Its thickness can be selected for a desired application. This material is manufactured commercially by compressing under heat a significantly thicker and less dense material to provide the desired medium density backing material. Mat 17 is of the same commercially available type described above and has a thickness of about 0.030 inches and is essentially transparent. It has been discovered that the two materials can be bonded together by pressing layer 15 together with mat 17 at a temperature of about 350° F. The resin binder typically in or added to the backing material is sufficient to provide a secure bond between the mat and the medium density backing material. The combination provides a tackable (i.e. structural member to which items can be fastened) and acoustically absorptive material which can be used in combination with the septum and/or low density filler material as in the preferred embodiment of the invention or by itself for less critical acoustically related applications.

It will become apparent to those skilled in the art that these and other modifications to be preferred embodiments of the invention as described herein can be made without departing from the spirit or scope of the invention as defined by the appended claims.

The embodiments of the invention in which an exclusive property or privilege is claimed are defined as follows:

1. An acoustical panel comprising:

a septum made of an air impervious material;

a layer of low density sound absorbing material positioned adjacent to an exterior side of said septum, and constructed to absorb sound waves therein; and a layer of medium density material positioned adjacent to an exterior side of said low density layer, and constructed to absorb sound waves therein for absorption-type sound attenuation;

said layer of medium density material having perforations extending laterally therethrough for Helmholtz-type sound attenuation.

2. The panel as defined in claim 1 wherein said perforated material has a perforation ratio of from about 0.03 to 0.05.

3. The panel as defined in claim 2 wherein said perforated material has a perforation ratio of 0.04.

4. The panel as defined in claim 3 wherein said low density material has a density of from about ½ to 3 pounds per cubic foot.

5. The panel as defined in claim 4 wherein said perforated material is made of a material having a density of from about 6 to 14 pounds per cubic foot.

6. The panel as defined in claim 5, including:

a layer of fibrous, acoustically transparent mat attached to an exterior side of said medium density layer for improved panel rigidity and tackability, and having perforations therein which are aligned with the perforations in said medium density layer.

7. The panel as defined in claim 6 and further including an acoustically transparent fabric positioned to cover an exterior side of said mat.

8. The panel as defined in claim 7, wherein:

said mat is integrally bonded to said medium density layer.

9. The panel as defined in claim 8, wherein:

said medium density layer is about ¼ inch thick.

10. The panel as defined in claim 9, wherein:

said mat is about 0.030 inches thick.

11. The panel as defined in claim 10, wherein:

said low density layer is about ⅞ inches thick.

12. The panel as defined in claim 1, wherein said low density material has a density of from about ½ to 3 pounds per cubic foot.

13. The panel as defined in claim 1, wherein said perforated material is made of a material having a density of from about 6 to 14 pounds per cubic foot.

14. The panel as defined in claim 1, including:

a layer of fibrous, acoustically transparent mat attached to an exterior side of said medium density layer for improved panel rigidity and tackability, and having perforations therein which are aligned with the perforations in said medium density layer.

15. The panel as defined in claim 14, and further including an acoustically transparent fabric positioned to cover an exterior side of said mat.

16. The panel as defined in claim 1, wherein:

said medium density layer is about ¼ inch thick.

17. The panel as defined in claim 1, wherein:

said low density layer is about ⅞ inches thick.

* * * * *

UNITED STATES PATENT AND TRADEMARK OFFICE

CERTIFICATE OF CORRECTION

PATENT NO. : 4,441,580

DATED : April 10, 1984

INVENTOR(S) : Michael P. Webster

It is certified that error appears in the above-identified patent and that said Letters Patent is hereby corrected as shown below:

Column 1, line 11:
"existant" should be --existent--;

Column 1, line 34:
"existant" should be --existent--;

Column 1, line 39:
"decible" should be --decibel--

Column 2, line 38:
"feet" should be --foot--;

Column 2, line 46:
"speciality" should be --specialty--;

Column 2, line 64:
"14" should be --17--;

Column 4, Claim 8, line 41:
"7" should be --6--

Signed and Sealed this

*Sixth* Day of *November 1984*

[SEAL]

*Attest:*

*Attesting Officer*

GERALD J. MOSSINGHOFF

*Commissioner of Patents and Trademarks*